US005558003A

United States Patent [19]

Bauzou et al.

[11] Patent Number: 5,558,003

[45] Date of Patent: Sep. 24, 1996

[54] HYDRAULIC MOTOR PROVIDED WITH A DEVICE FOR SELECTING ITS ACTIVE CUBIC CAPACITY

[75] Inventors: Philippe P. Bauzou, Compiegne; Jean-Claude F. Case, Bonneuil-en-Valois, both of France

[73] Assignee: Poclain Hydraulics, France

[21] Appl. No.: 302,549

[22] Filed: Sep. 8, 1994

[30] Foreign Application Priority Data

Sep. 15, 1993 [FR] France ..... 93 10972

[51] Int. Cl.[6] ..... F01B 13/06

[52] U.S. Cl. ..... 91/492; 60/483; 417/273

[58] Field of Search ..... 60/483; 91/492; 417/273

[56] References Cited

U.S. PATENT DOCUMENTS 4,202,252 5/1980 Scheufler et al. ..... 91/492
4,398,450 8/1983 Louhio ..... 91/492
4,445,423 5/1984 Louhio ..... 91/492
5,001,964 3/1991 Allart et al. ..... 91/519

FOREIGN PATENT DOCUMENTS 2243881 11/1991 United Kingdom .
2253658 9/1992 United Kingdom .
2258696 2/1993 United Kingdom .

*Primary Examiner*—Charles Freay
*Attorney, Agent, or Firm*—Ladas & Parry

[57] ABSTRACT

The invention relates to a hydraulic motor having a plurality of cubic capacities, and provided with individual cubic-capacity selectors associated with at least some of its cylinders, each selector being provided with a control member. According to the invention, the control member coupled to each of said individual selectors can be activated only in that range of positions of the cylinder associated with said individual selector which corresponds to the axis of said cylinder being in alignment with the crest of one of the undulations, and to positions that are angularly adjacent to the position in which said alignment is obtained. An application of the invention is to making a motor that is mechanically strong.

9 Claims, 13 Drawing Sheets

HYDRAULIC MOTOR PROVIDED WITH A DEVICE FOR SELECTING ITS ACTIVE CUBIC CAPACITY

BACKGROUND OF THE INVENTION

Use of hydraulic motors has led to motors being designed that have a plurality of active cubic capacities in operation. For example, in motors having radial pistons, it is known that either all of the cylinders can be fed periodically with fluid under pressure, which corresponds to the maximum cubic capacity of the motor, or else the feed of fluid under pressure can be interrupted to some only of the cylinders, which corresponds to an intermediate cubic capacity of the motor, which capacity may even be reduced to zero. For those of the cylinders which are momentarily isolated from the supply of fluid under pressure, it is also known that the pistons which are slidably mounted in those cylinders can be "disengaged" by causing said pistons to cease to abut against the cam, thereby preventing friction and premature wear. To this end, in that known technique, a "disengaging" device enables said pistons to be kept in the configuration in which they are retracted inside their respective cylinders. The main drawback with that technique lies in "disengaging" all of the pistons simultaneously without taking account of their relative instantaneous positions relative to the cam. Difficulties are encountered during the "disengagement", and when certain additional and costly precautions are not taken, such difficulties sometimes give rise to interference between the cam and a piston that is not fully retracted inside its cylinder, and to violent crashing. But even greater difficulties exist when the reverse operation is performed, consisting in putting the pistons back into abutment against the cam ("re-engagement").

OBJECT AND SUMMARY OF THE INVENTION

An object of the invention is to remedy those drawbacks by providing a novel motor in which the "disengagement" and "re-engagement" of each of the "disengageable" pistons are performed when the piston is placed facing a crest of the cam, thereby preventing any violent crashing between the piston and the cam.

FR-A-1 249 873 describes a prior art hydraulic motor having radial pistons and a device for selecting its active cubic capacity, the motor comprising: a cam having a plurality of undulations, each undulation comprising a crest placed between two troughs; a cylinder block mounted to rotate about an axis of rotation relative to the cam; a plurality of cylinders provided in the cylinder block, and disposed radially relative to said axis of rotation; a plurality of pistons slidably mounted inside the cylinders, each piston delimiting a fluid working chamber inside the cylinder in which it is mounted, and being urged against said cam under drive from the pressure of a fluid under pressure contained in said working chamber; a main inlet fluid enclosure for a fluid under pressure and a main outlet fluid enclosure; an internal fluid distributor co-operating while the cylinder block rotates relative to the cam to put each working chamber into communication alternately with the main inlet enclosure and with the main outlet enclosure; a plurality of individual feed selectors disposed in the cylinder block, each individual selector being associated with a cylinder belonging to a specific group of said cylinders, and being interposed between the working chamber delimited inside said cylinder and the internal fluid distributor; and return means tending to return the pistons slidably mounted in the cylinders of said specific group of cylinders towards the configuration in which they are retracted inside their respective cylinders; the motor being organized in such manner that firstly each individual selector can be placed in two specific configurations, it being coupled for that purpose both to a return member for returning it to one of said specific configurations, and to a control member for putting it in place in its other specific configuration, which control member is connected to a control device, and has the opposite effect to that of the return member; secondly, when said individual selector is in a first configuration, the working chamber delimited inside the cylinder associated with the individual selector can, while the cylinder block is rotating relative to the cam, be put into communication alternately with the main inlet enclosure and with the main outlet enclosure via the internal fluid distributor; and thirdly, when said individual selector is in the second one of said two configurations, said working chamber is isolated at least from the main inlet enclosure.

According to the present invention the control member coupled to each of said individual selectors can be activated only in that range of positions of the cylinder associated with said individual selector which corresponds to the axis of said cylinder being in alignment with the crest of one of said undulations of the cam, and to positions that are angularly adjacent to the position in which said alignment is obtained.

The following advantageous dispositions are also preferably chosen:

each control member includes an individual feed link for feeding control energy, the control device for controlling the various control members is coupled to the cam and includes at least one control link that can be selectively put into communication with a control energy source, and, while the cylinder block is being rotated relative to the cam, said feed links for feeding the various control members are individually put into communication with a control link from the control device;

said control device coupled to the cam is mounted to pivot relative to said cam about said axis of rotation, so as to be subjected to an angular offset of determined value between two positions that it can take up, one of which positions corresponds to said cylinder block being rotated relative to the cam in a first rotation direction, the other position corresponding to said cylinder block being rotated relative to the cam in the opposite direction;

each individual selector includes a drain duct which, when the individual selector is in the second configuration, connects said working chamber to an unpressurized enclosure;

the motor includes two groups of cylinders whose axes are contained in distinct planes that are mutually parallel, and that are perpendicular to the axis of rotation, the cylinders of a first one of said two groups constituting said specific group of cylinders, the individual selectors associated with the cylinders of said first group of cylinders being disposed radially, each cylinder lying substantially in the radial plane containing the axis of the associated cylinder, and also being disposed between the radial planes containing the axes of two successive cylinders of the second group of cylinders;

the control member of each individual selector comprises a fluid actuator having a driving chamber and provided with a feed channel constituting said feed link which, while the cylinder block is rotating relative to the cam, can communicate with a control channel constituting said control link, coupled to the cam, which control channel is itself selectively connected to a control fluid source via a control fluid distributor;

the return member coupled to each individual selector comprises a spring;

the motor includes a casing which delimits a sealed enclosure containing said cylinder block, and said return means for returning the pistons towards the configuration in which they are retracted inside the cylinders are constituted by said enclosure being put into communication with a source of fluid under pressure and by drive from the pressure of the fluid under pressure contained in said enclosure; and each individual selector comprises a moving member which is mounted to slide relative to the cylinder block parallel to a slide axis, which is constrained to rotate with the cylinder block about said slide axis, and which is provided with a through hole which, when the individual selector is in said first configuration, can put the associated cylinder into communication with the internal fluid distributor.

The main advantage of a motor of the invention lies in the way it makes it possible to select the active cubic capacity smoothly while the motor is in operation, i.e. with crashing between the rollers and the cam being eliminated both when going from a large active cubic capacity to a small active capacity, and also, conversely, when going from the small cubic capacity to the large cubic capacity. Therefore, it is no longer necessary to stop the motor in order to select the active cubic capacity thereof, and this enables such a motor to be used more flexibly and more fully.

BRIEF DESCRIPTION OF THE DRAWINGS

The invention will be better understood, and secondary characteristics and their advantages will appear on reading the following description of embodiments given by way of example.

It is to be understood that the description and the drawings are given by way of non-limiting example only.

Figure 1:
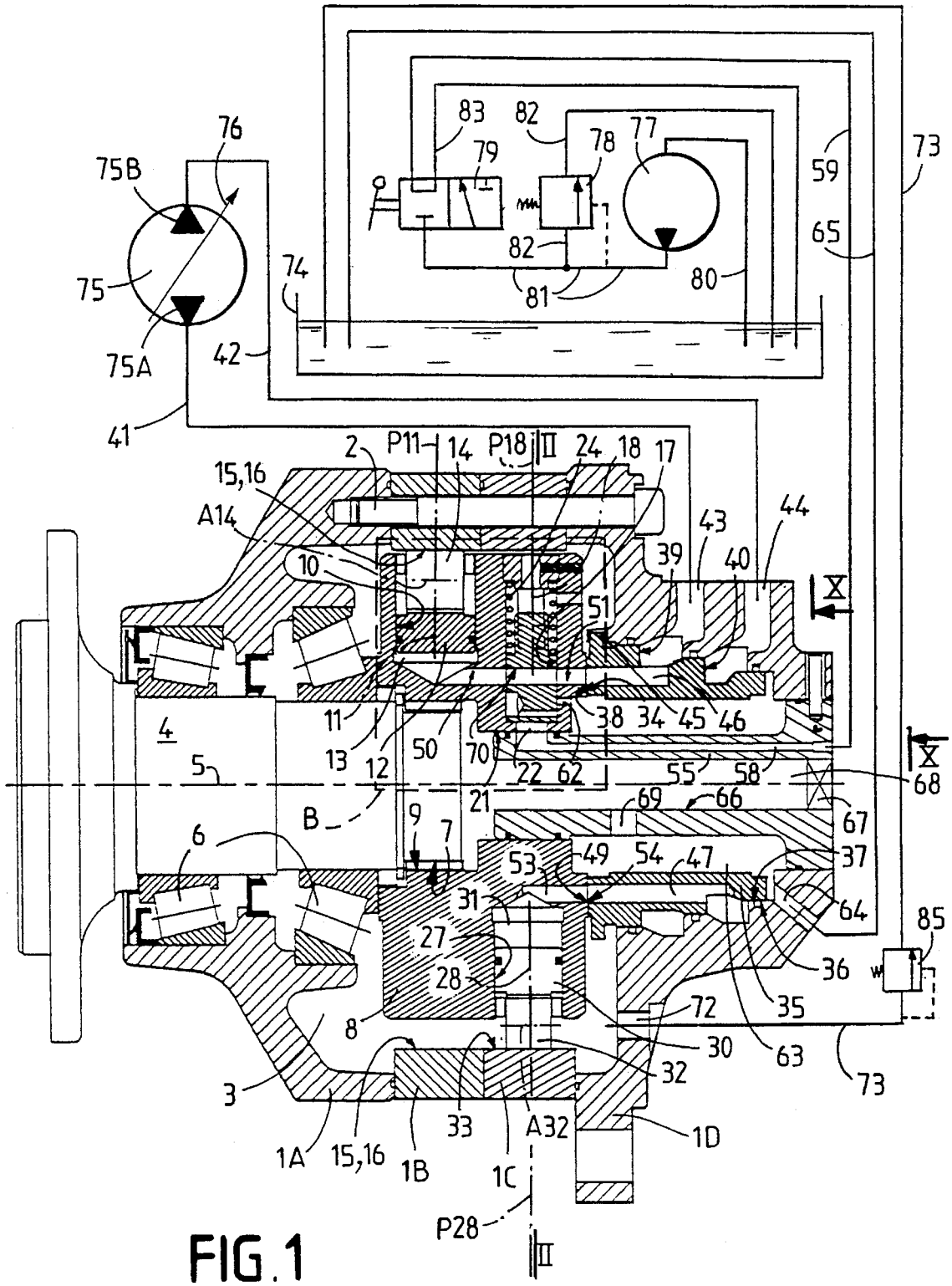
Figure 2:
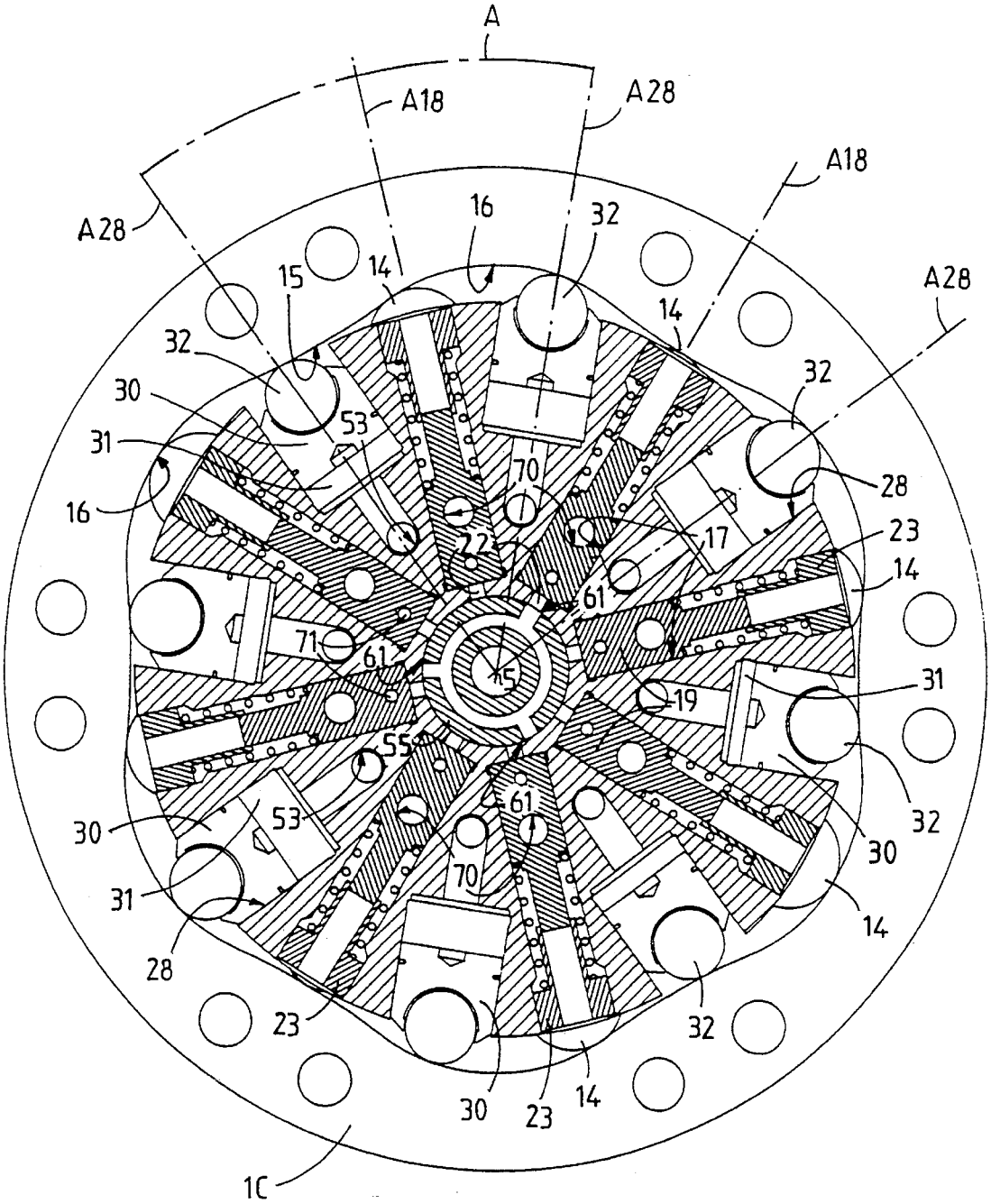
Figure 3:
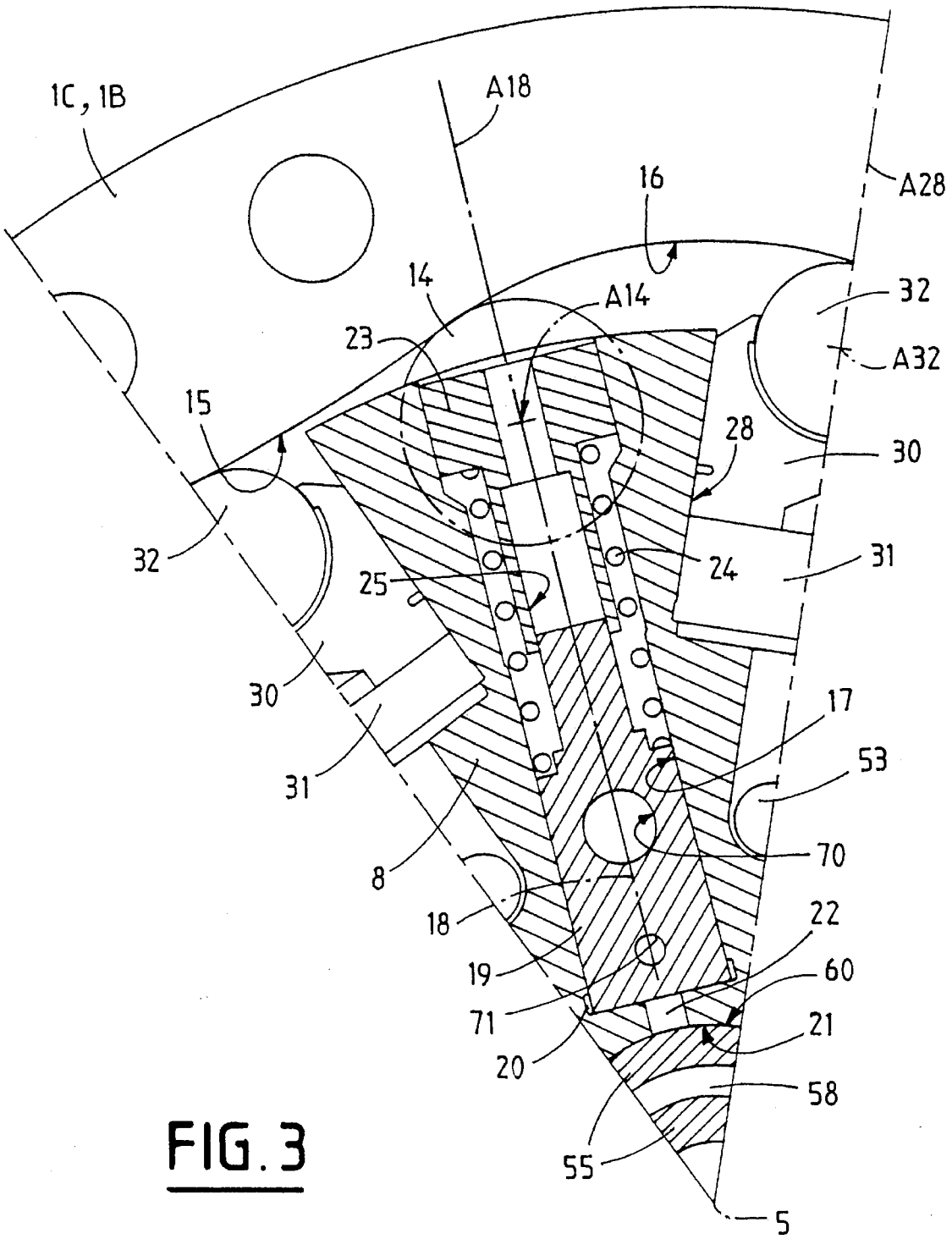
Figure 4:
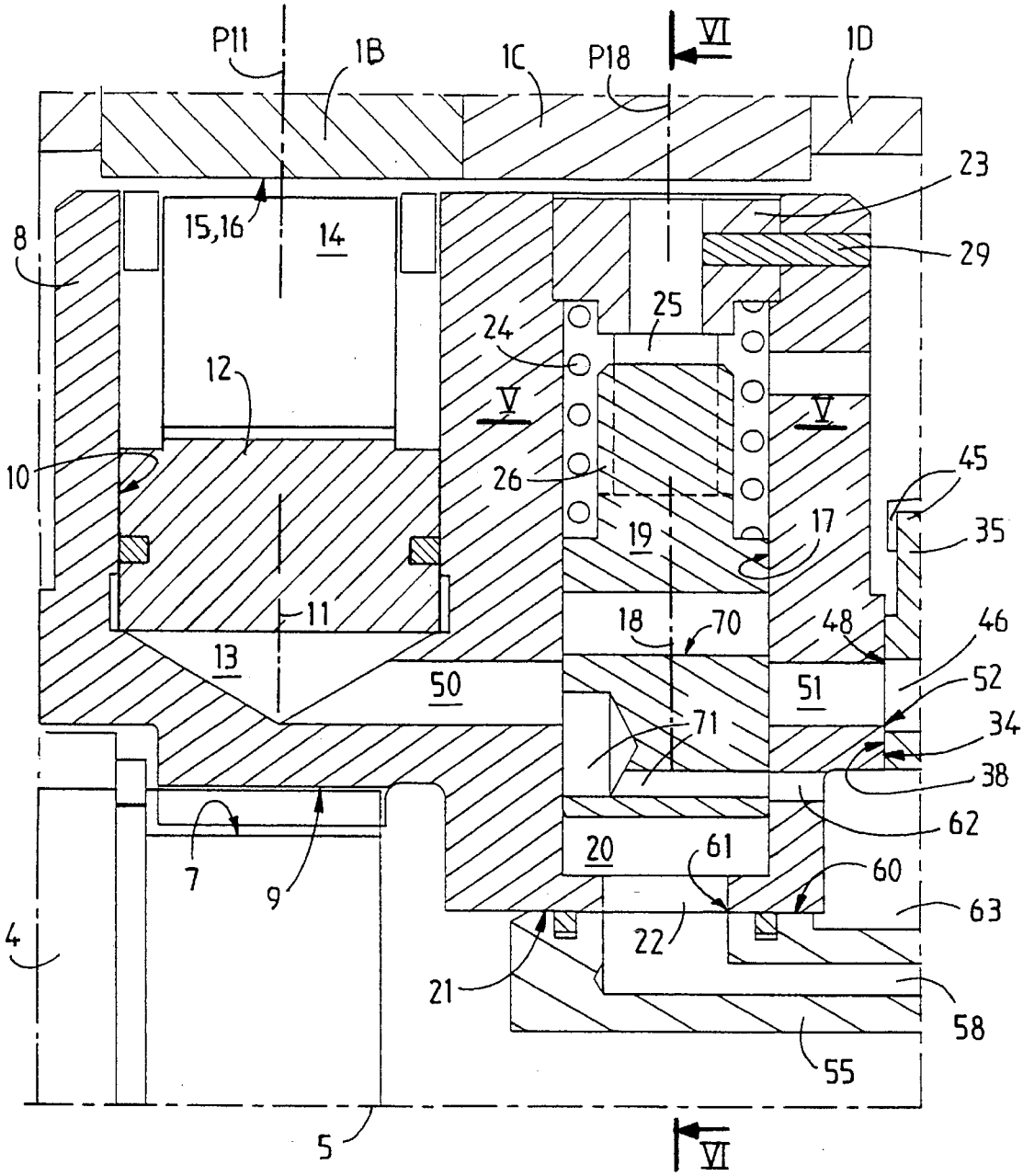
Figure 5:
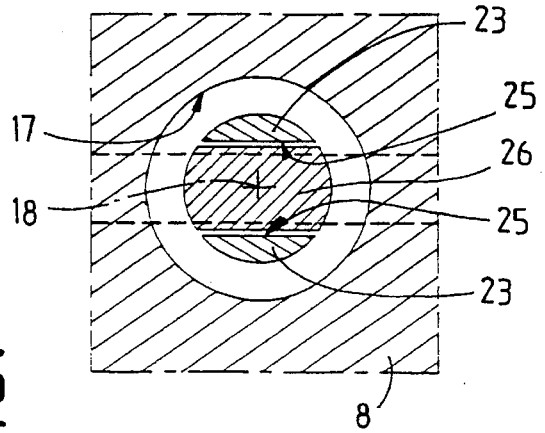
Figure 6:
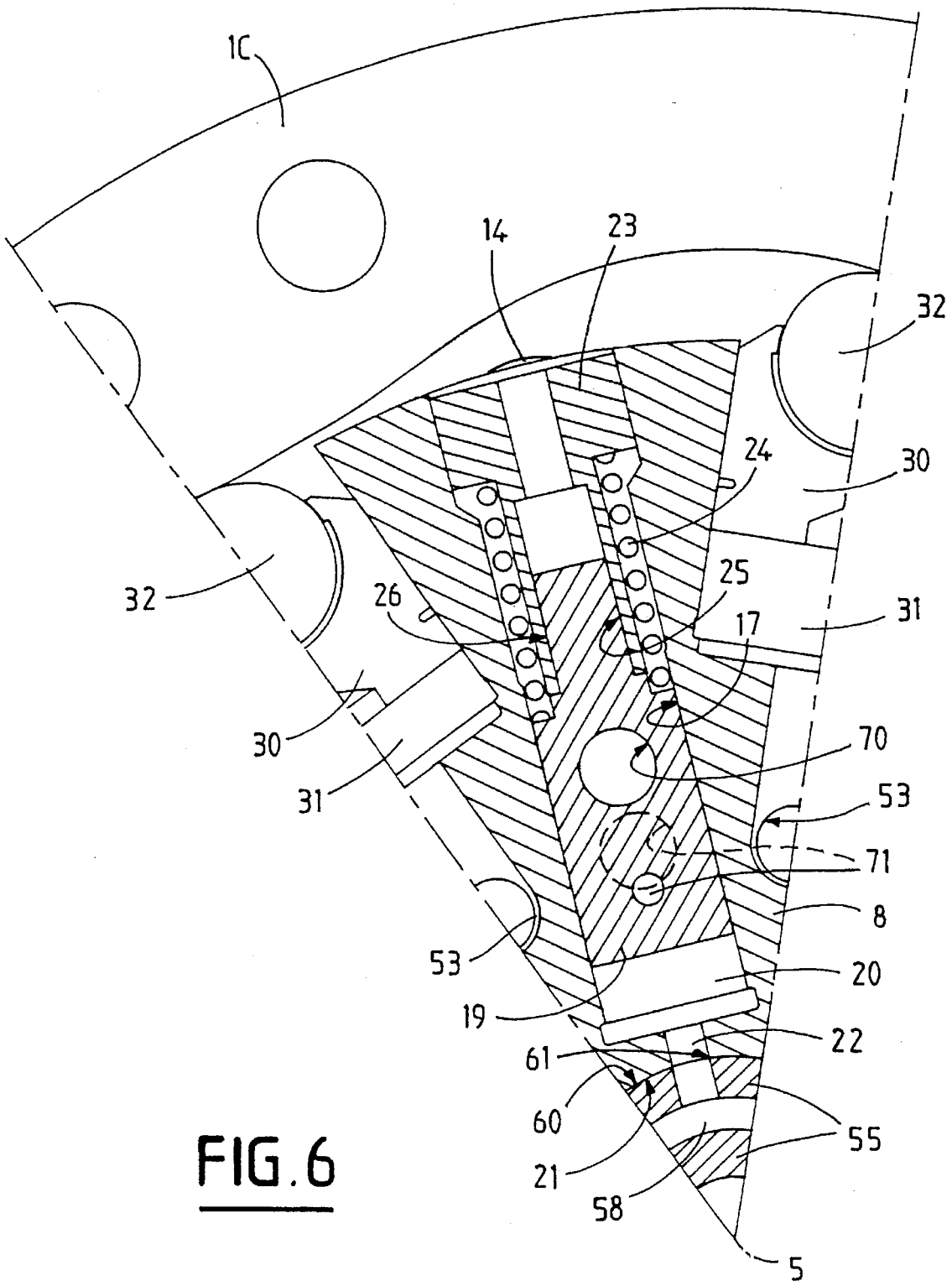
Figure 7:
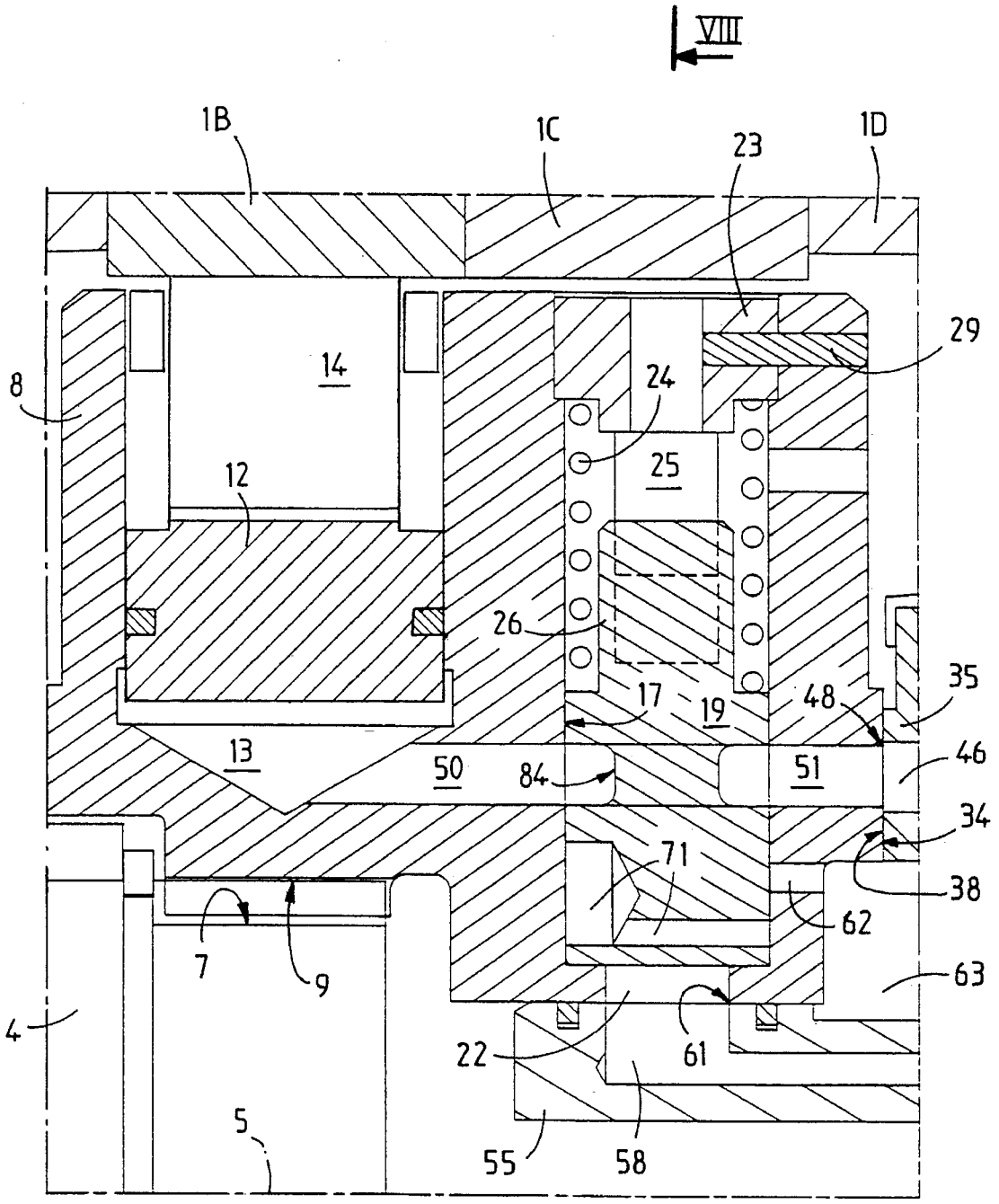
Figure 8:
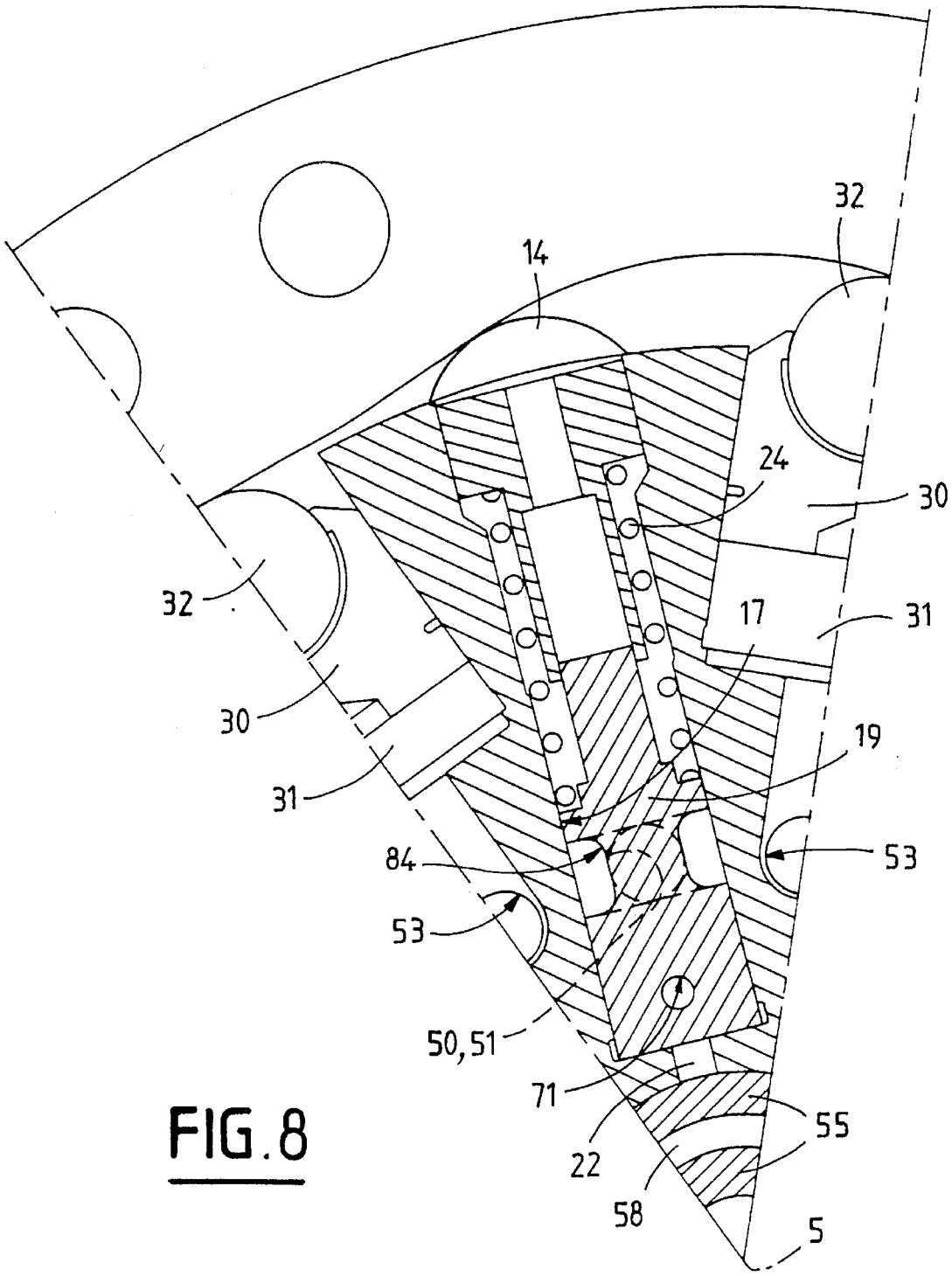
Figure 9:
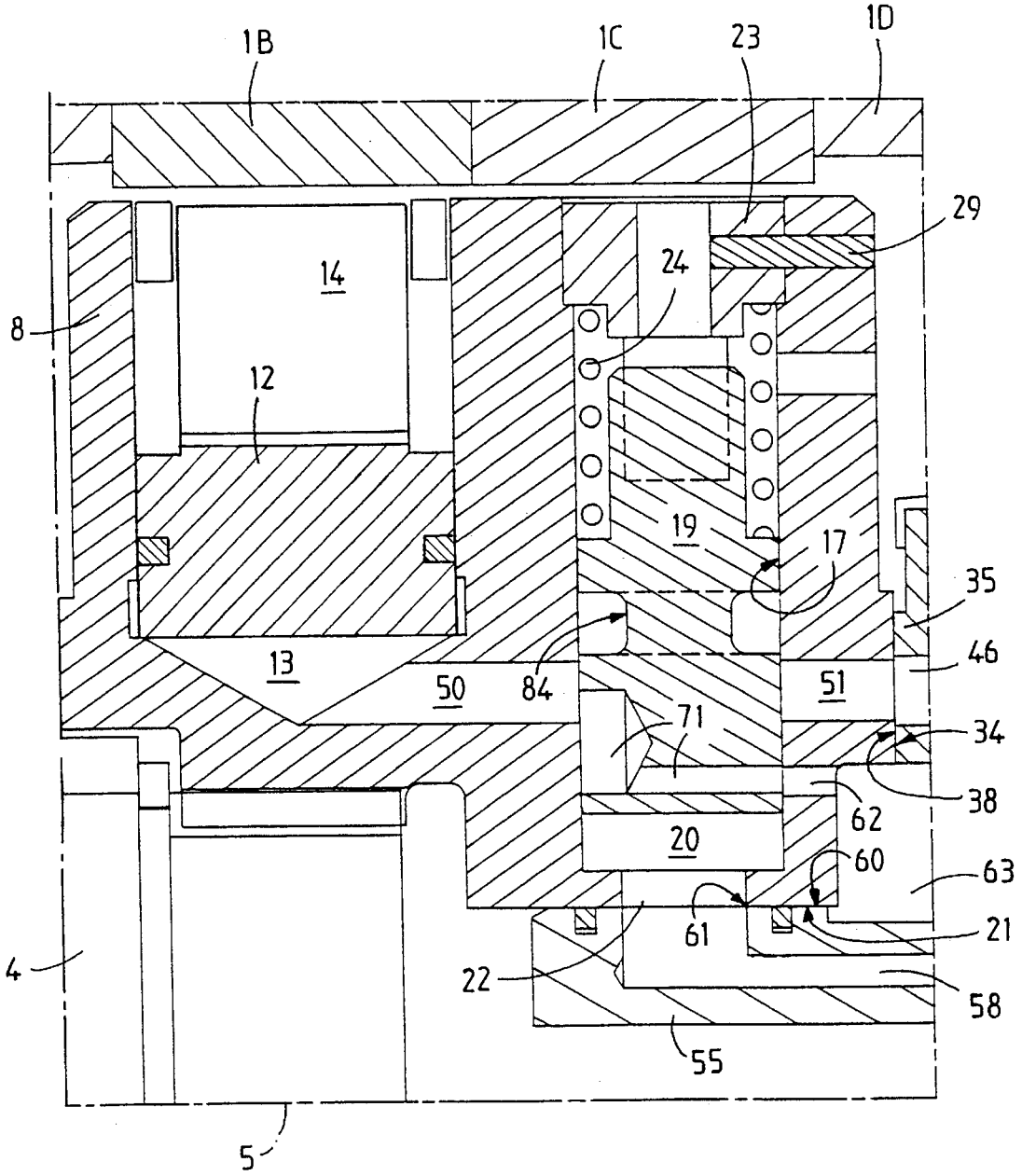
Figure 10:
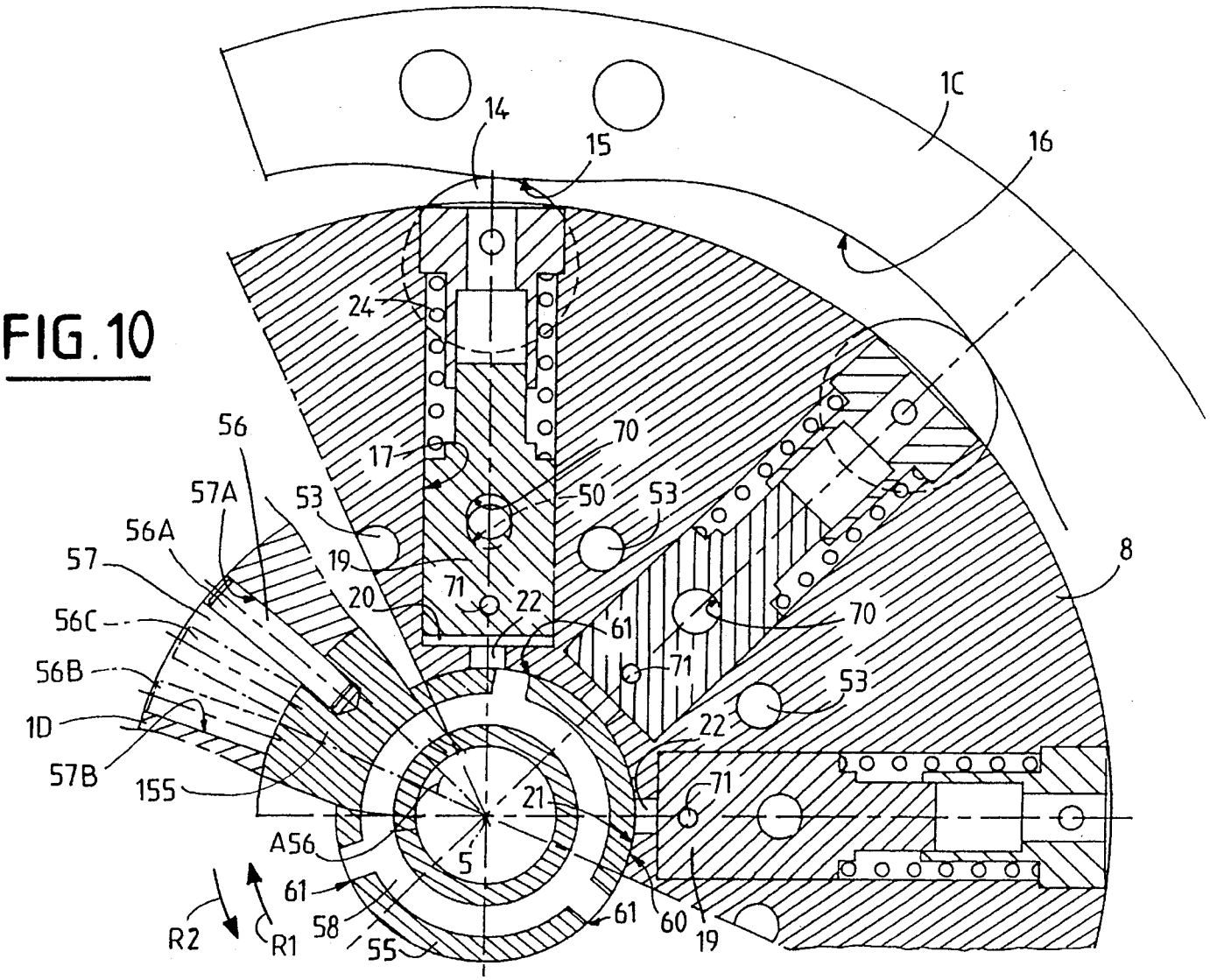
Figure 11:
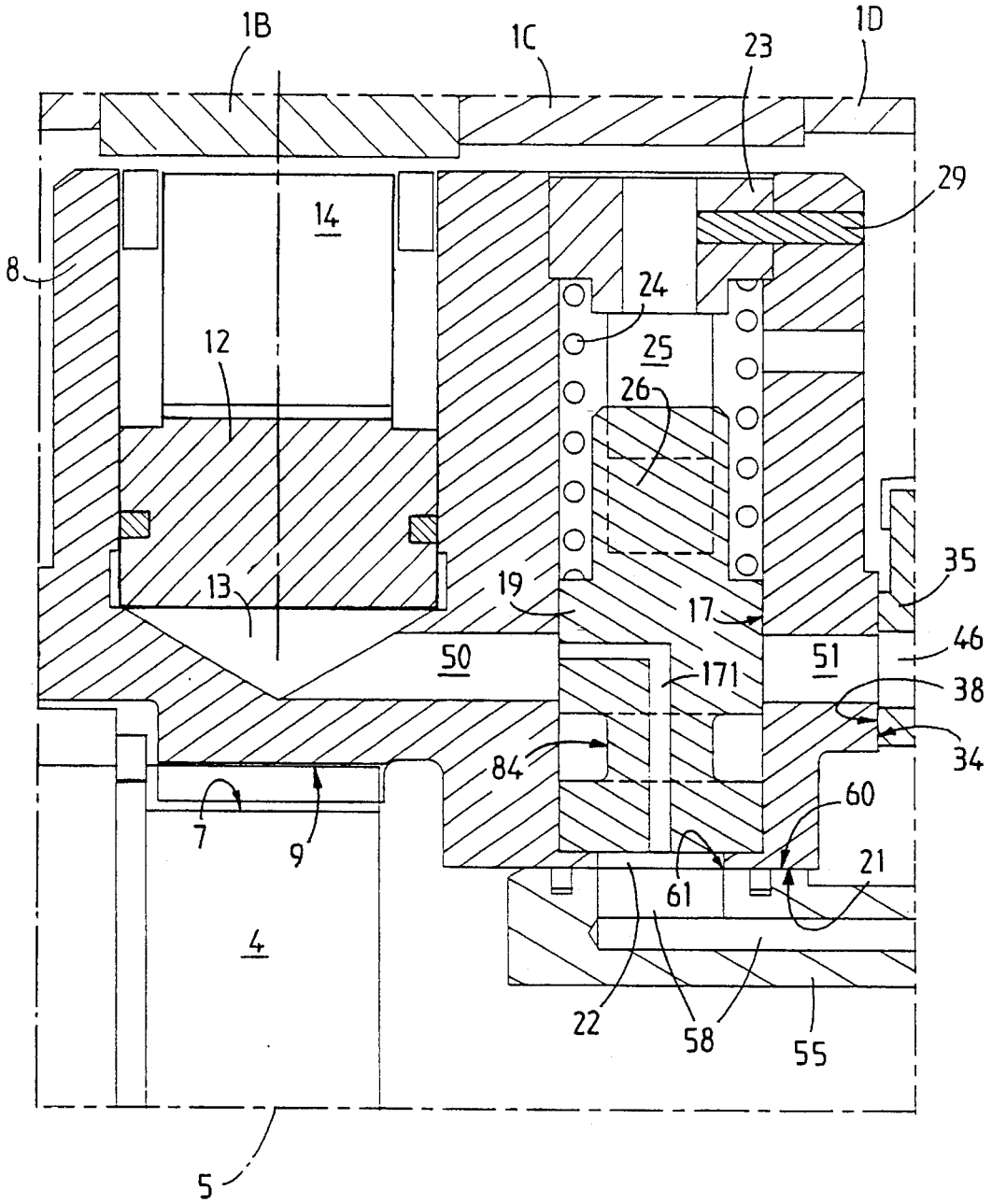
Figure 12:
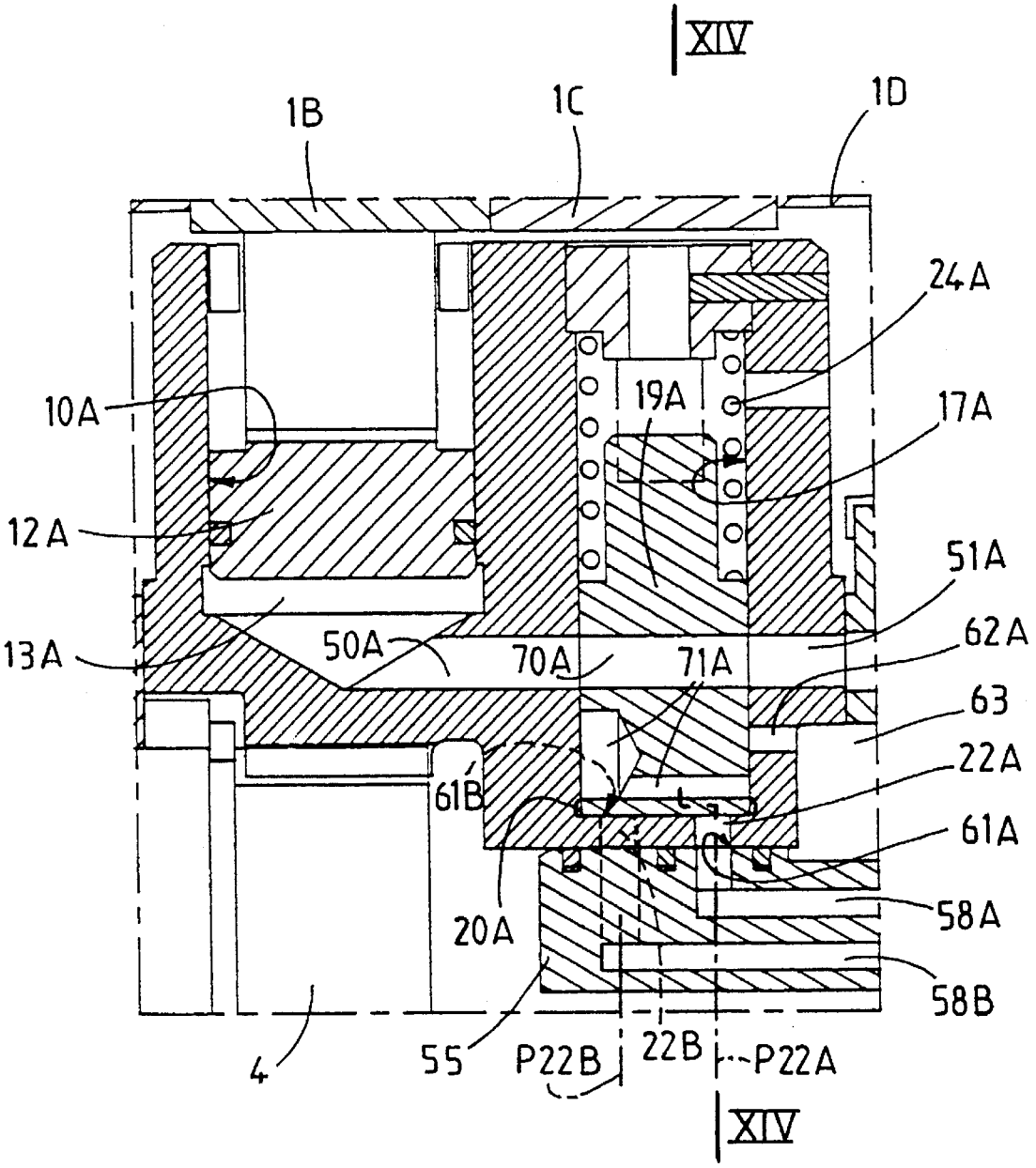
Figure 13:
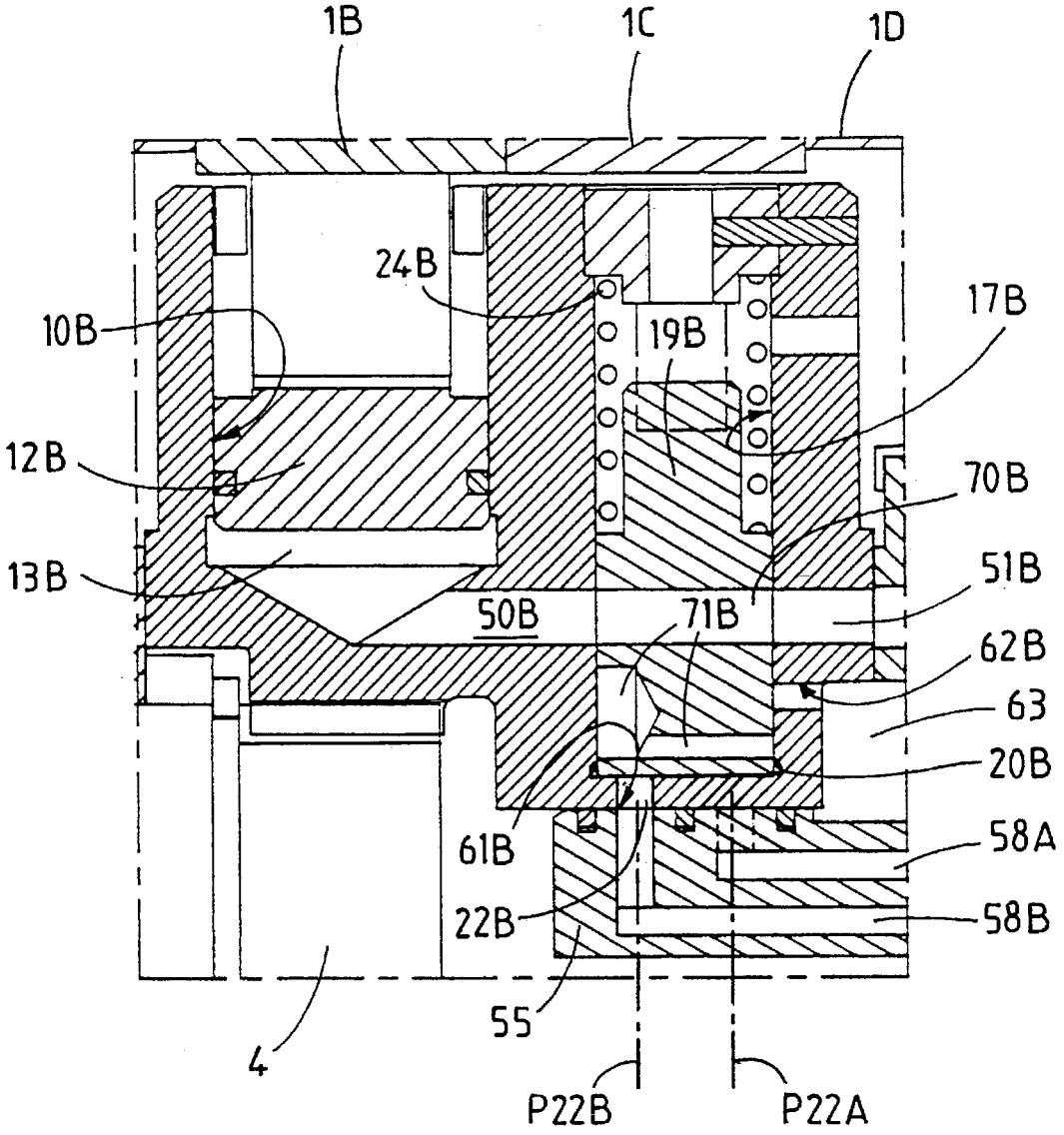
Figure 14:
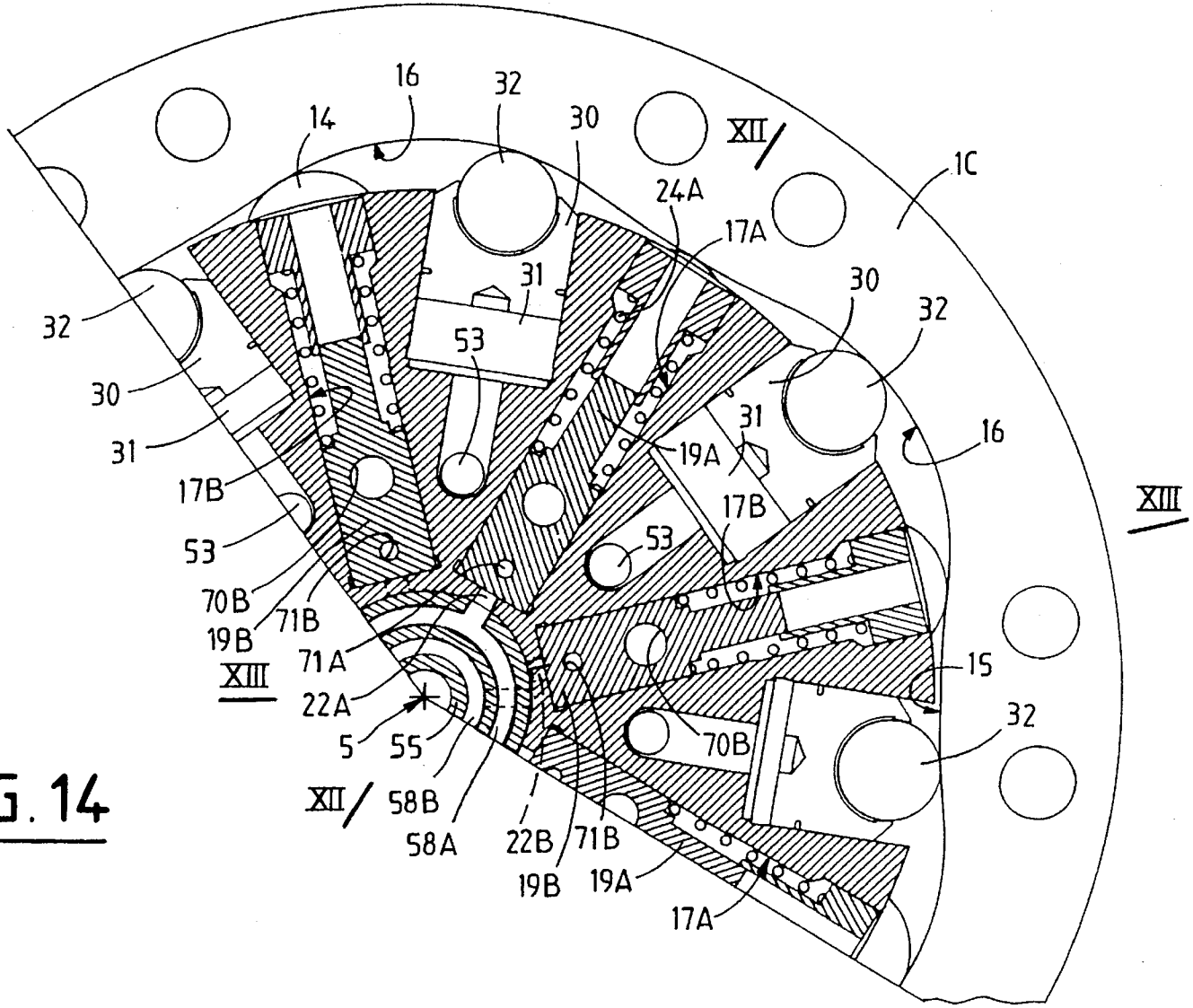

Reference is made to the accompanying drawings, in which:

FIG. 1 is a complete axial section through a first embodiment of a hydraulic motor of the invention, corresponding to a first configuration of the motor, supplemented by a diagram showing the control circuit for said motor;

FIG. 2 is a section on II—II of FIG. 1;

FIG. 3 is an enlarged view of detail A of FIG. 2;

FIG. 4 is an enlarged view of portion B of FIG. 1, corresponding to a second configuration of the motor;

FIG. 5 is a section on V—V of FIG. 4;

FIG. 6 is a section on VI—VI of FIG. 4;

FIG. 7 is a section analogous to that of FIG. 4, showing a second embodiment of the invention, in said first configuration of the motor;

FIG. 8 is a section on VIII—VIII of FIG. 7;

FIG. 9 is a section analogous to that of FIG. 7, showing the same motor, in its second configuration;

FIG. 10 is a view analogous to that of FIG. 3, of the same motor, and showing a plurality of individual selectors, supplemented by a section on X—X of FIG. 1;

FIG. 11 is a section analogous to that of FIG. 4, through a third embodiment of the motor of the invention, in its second configuration;

FIGS. 12 and 13 are sections respectively on XII—XII and on XIII—XIII of FIG. 14, through a fourth embodiment of the motor of the invention, in its first configuration; and FIG. 14 is a section on XIV—XIV of FIG. 12.

MORE DETAILED DESCRIPTION

The hydraulic motor shown in FIGS. 1 to 6 comprises:

a motor casing in four portions 1A, 1B, 1C, and 1D assembled together by screws 2, and delimiting a first sealed enclosure 3;

an output shaft 4 mounted to rotate relative to portion 1A of the casing, about an axis of rotation 5, and via roller bearings 6, the shaft having one of its ends contained inside said enclosure 3 and provided with fluting 7;

a cylinder block 8 contained inside the enclosure 3, and constrained to rotate with the output shaft 4 about the axis 5 by means of fluting 9 provided in a central bore in the cylinder block 8;

a group of first main cylinders 10 provided in the cylinder block 8, and disposed radially relative to the axis of rotation 5, so that their axes 11 are firstly regularly angularly spaced-apart, and are secondly contained in a common transverse plane P11 that is perpendicular to the axis of rotation 5;

first main pistons 12 slidably mounted in the first main cylinders 10, each piston delimiting a first working chamber 13 for a fluid, inside a first main cylinder, and supporting a roller 14 at that one of its ends which is opposite from the first chamber 13, the roller having an axis A14 parallel to the axis of rotation 5, and rolling on the inside periphery of portion 1B of the casing, which portion is shaped into a first cam (15–16) constituted by a succession of undulations, each of which is delimited by a crest 15 placed between two troughs 16;

a group of secondary cylinders 17 provided in the cylinder block 8 and disposed radially relative to the axis of rotation 5, each of their axes 18 being contained in a respective one of the same radial planes A18 as those containing the axes 11 of the first main cylinders 10, and all of the axes 18 being contained in a common transverse plane P18 perpendicular to the axis of rotation 5, which transverse plane is naturally distinct from plane P11, the first main cylinders 10 and the secondary cylinders 17 not interfering with one another;

secondary pistons 19 slidably mounted in the secondary cylinders 17, each piston delimiting a chamber 20 for receiving a control fluid inside a second cylinder 17, which chamber communicates with a bore 21 provided in the cylinder block 8 and having its axis coinciding with the axis of rotation 5, the chamber communicating with the bore via a selector duct 22 provided in said cylinder block;

covers 23 each of which is fixed via a pin 29 to the piston block 8 at that end of a secondary cylinder 17 which is further from the bore 21, the cover preventing the secondary piston 19 from coming out of its corresponding secondary cylinder 17, each cover firstly forming an abutment for a return spring 24 for returning the secondary piston 19 to a first position in which the minimum volume is obtained for chamber 20, and secondly also being provided with slideway guides 25 for guiding and maintaining the angular position of a slide 26 that has a polygonal cross-section, and that is integral with said secondary piston 19, the cover 23 therefore having a constant angular position relative to the axis 18 of the secondary cylinder 17, and, as a result, the secondary piston 19 also having such a constant angular position relative to said axis 18;

a group of second main cylinders 27 provided in the cylinder block 8 and disposed radially relative to the axis of rotation 5, their axes 28 being substantially contained in the axial planes A28 bisecting two successive axial planes A18 containing the axes 18 of two successive secondary cylinders 17, and the axes 28 of all of the second main cylinders 27 being contained in a common transverse plane P28 that is perpendicular to the axis of rotation 5, which plane lies between transverse planes P11 and P18, and is close to transverse plane P18, each second main cylinder 27 thus being disposed substantially between two secondary cylinders 17, while being slightly offset axially relative to the secondary cylinders;

second main pistons 30 slidably mounted in the second main cylinders 27, each piston delimiting a second working chamber 31 for a fluid inside a second main cylinder 27, and supporting a roller 32 at that one of its ends which is opposite from the second chamber 31, the roller having an axis A32 parallel to the axis of rotation 5, and rolling on the inside periphery of portion 1C of the casing, which portion is shaped into a second cam 33 constituted by a succession of undulations;

a plane communication face 34 perpendicular to the axis of rotation 5 and belonging to the cylinder block 8;

an internal fluid distributor 35 which has an axial face 36 whose shape is complementary to the shape of an axial face 37 of a recess in portion 1D of the casing, and which is also provided with a plane distribution face 38 that is perpendicular to the axis of rotation 5 and that abuts in substantially fluid-tight manner against the communication face 34;

two grooves 39, 40 that are circularly symmetrical about axis 5, that are provided between the axial faces 36 and 37 in contact, and that are connected to respective external ducts 41, 42 via respective internal ducts 43, 44 provided in portion 1D of the casing;

a stud-and-notch device 45 for preventing the internal fluid distributor 35 from rotating about axis 5 with respect to portion 1D of the casing;

two groups of distribution ducts 46, 47 connecting respective ones of the grooves 39, 40 to the distribution face 38 in which they open out alternately via orifices 48, 49 centered on a common circle of axis 5;

a first group of pairs of cylinder ducts 50, 51 provided in the cylinder block 8, one cylinder duct 50 of a pair connecting a chamber 13 to a secondary cylinder 17 in which it opens out, and the other cylinder 51 of the pair connecting said secondary cylinder 17 to the communication face 34 in which it opens out via an orifice 52, all of the orifices 52 being centered on the same circle as the orifices 48, 49 of the distribution ducts 46, 47;

a second group of cylinder ducts 53 provided in the cylinder block 8, each cylinder duct connecting a chamber 31 to the communication face 34 in which it opens out via an orifice 54, all of the orifices 54 being centered on the same circle as the orifices 48, 49 of the distribution ducts 46, 47;

a pivoting ring 55, provided with a cylindrical face 60 corresponding to the bore 21 in the cylinder block 8 and abutting in fluid-tight manner against said bore 21, and provided with a stud 56 which is secured to the ring 55 via a flange 155 that is integral therewith, which is received in a transverse recess 57 provided in portion 1D of the casing, and which can abut against the walls delimiting the recess 57 in a first: position 56A, or in a second position 56B; an internal duct 58 is provided in the ring 55, which duct is connected to an external control duct 59 and opens out via an orifice 61 in the cylindrical face 60, so that, while the cylinder block 8 is rotating relative to the cam 15–16 (or relative to the casing 1A–1B–1C–1D), each selector duct 22 is put into communication periodically with the orifice 61 of the internal duct 58; positions 56A and 56B of the stud correspond to a the ring 55 pivoting through a pivot angle A56 which is small, and not more than 0.2 to 0.3 times the angular amplitude between two successive troughs (or two successive crests) of the cam, so that it is possible to say that position 56C is adjacent to both of the end positions 56A, 56B;

through holes 62 provided in the wall of the cylinder block 8 and permanently opening out into a second enclosure 63 delimited inside the casing (1A–1B–1C–1D) between the ring 55, the internal fluid distributor 35, the cylinder block 8 and said casing, each hole 62 further opening out into a secondary cylinder 17;

an internal duct 64 provided in the wall of the casing (1A–1B–1C–1D) connecting the enclosure 63 to an external duct 65;

the ring 55 includes a central bore 66 of axis 5, which bore is closed at one of its ends by a plug 67 co-operating with the transverse face of the inside end of the shaft 4 and with the cylinder block 8 to delimit an enclosure 68 which communicates with the enclosure 63 via a hole 69 passing through the wall of the ring 55;

each secondary piston 19 includes a connection duct 70 and a drain duct 71, both of which pass through it, and, when an orifice 61 placed facing a duct 22 can take up a first configuration (FIG. 1) in which the force of the spring 24 is greater than the drive from the pressure of the fluid contained in ducts 58 and 22, and in chamber 20, and in which configuration firstly the cylinder ducts 50, 51 of each pair communicate with each other via the connection duct 70, and secondly the drain duct 71 is closed off by the wall of the cylinder 17, and a second configuration (FIG. 4) in which the force of the spring 24 is less than the drive from the pressure of said fluid, and in which firstly the connection duct 70 is closed off by the wall of the cylinder 17, and secondly cylinder duct 50 is put into communication with hole 62 via the drain duct 71, cylinder duct 51 being closed off by the piston 19; and a hole 72 passing through the casing (1A–1B–1C–1D) connects the enclosure 3 to an external duct 73.

The hydraulic motor is further connected to a control circuit comprising:

a fluid tank 74;

a reversible main pump 75 of variable cubic capacity having two main couplings 75A, 75B, an arbitrary one of which constituting the delivery coupling of the pump, and the other one constituting the suction coupling of the pump which further includes an adjustment member 76 for adjusting its cubic capacity;

a control pump 77;

a discharge valve 78 for providing protection against excess pressure;

a fluid distributor 79 having two positions;

a pressure-retaining valve 85; and the following ducts:

the ducts 41, 42 connected to respective ones of the main couplings 75A, 75B of the main pump 75;

the suction duct 80 of the control pump 77, connecting it to the tank 74;

the delivery duct 81 of the control pump 77, connecting it to the two-position fluid distributor 79;

a duct 82 connecting the delivery duct 81 to the tank 74, the discharge valve 78 being placed on duct 82;

a duct 83 connecting the two-position fluid distributor to the tank 74;

the duct 59 coupled to the two-position fluid distributor 79; and the ducts 65 and 73 coupled to the tank 74, the retaining valve 85 being placed on duct 73.

The two positions of the two-position fluid distributor 79 correspond to the following situations:

the first position corresponds to ducts 59 and 83 communicating with each other and to duct 81 being closed off; and the second position corresponds to ducts 81 and 59 communicating with each other, and to duct 83 being closed off.

The following dispositions should be noted:

with reference to FIGS. 1 and 10, in particular, it can be noted that the ring is substantially stationary relative to portion 1D of the casing, i.e. also relative to the cam 15–16, except for a small pivoting oscillation corresponding to the angular displacement of the stud between its end positions 56A and 56B;

the intermediate position 56C which is angularly equidistant from said end positions 56A, 56B corresponds to an orifice 61 being in a position in which full communication with a selector duct 22 is established simultaneously with the position in which the roller 14 of the first piston 12 associated with the secondary piston 19 delimiting the chamber 20 which communicates with said selector duct 22 is in contact with a crest 15 of the cam 15–16;

in the configuration shown in FIGS. 1, 2, and 3, all rollers 14 are in rolling contact with cam 15–16, as are all rollers 32 with cam 33;

in the embodiment shown, the outline of cam 33 is identical to and coincides angularly with that of cam 15–16, but this is not essential for implementing the invention;

each axial plane A18 bisects the dihedron formed by the two adjacent axial planes A28, and each axial plane A28 bisects the dihedron formed by the two adjacent axial planes A18, the various axial planes being regularly distributed angularly about axis 5; and in the embodiment shown, the ring 55 is provided with three orifices 61 regularly spaced-apart angularly at 120° intervals about axis 5, each of the orifices being capable of entering into communication with the ducts of three distinct selectors 22 with a small offset relative to each other, as shown in FIG. 2 in which a first orifice 61 is in communication with a duct 22, while a second orifice 61 is about to enter into communication with a second duct 22, and the third orifice 61 has just ceased to communicate with a third duct 22.

The embodiment shown in FIGS. 7 to 9 can be deduced from the embodiment shown in FIGS. 1 to 6 by providing a groove 84 in each secondary piston 19 instead of the connection duct 70, which groove opens out in the cylindrical face of the piston and has its axis of revolution coinciding with the axis of said secondary piston 19, so that, in a first configuration shown in FIGS. 7 and 8, the secondary piston 19 places cylinder ducts 50 and 51 in communication with groove 84, and the drain duct 71 is closed off by the wall of the cylinder 17, the force of the spring 24 then being greater than the drive from the pressure of the fluid contained in ducts 58 and 22, and in the chamber 20, and, in a second configuration shown in FIG. 9, the wall of the cylinder 17 closes off the groove 84, the secondary piston 19 closes off cylinder duct 51, cylinder duct 50 communicating with the hole 62 via the drain duct 71, the force of the spring 24 then being less than the drive from the pressure of said fluid.

FIG. 10 shows the configuration in which the ring 55 is rotated in direction R1, by means of the friction forces existing between the bore 21 in the cylinder block 8 and the cylindrical face 60 of said ring that is in fluid-tight contact with the bore. The stud secured to the ring 55 abuts against the face 57A of the recess 57 and takes up the position 56A corresponding to the ring 55 being temporarily stationary relative to portion 1D of the casing. It can be noted that, before the roller 14 of the first piston corresponding to the secondary piston 19 reaches the crest 15 of cam 15–16, the selector duct 22 corresponding to said secondary piston 19 has been put into communication with one of the orifices 61 in the ring 55. Naturally, by means of a sort of advance feed applied to the chamber 20 from the control fluid contained in duct 58, this enables a pressure force to be applied to said secondary piston in due time, which force is capable of pushing back said secondary piston, thereby causing the secondary piston 19 and the first cylinder 10 to pass from the first configuration shown in FIGS. 1 and 3 to the second configuration shown in FIG. 4. In the second configuration, instead of being fed periodically with the fluid under pressure coming from the main pump 75 and conveyed by ducts 51, 70 and 50, the chamber 13 of said first cylinder is put into communication with the unpressurized return to the tank 74, via ducts 50 and 71, hole 62, enclosure 63, internal duct 64 and external duct 65. When the cylinder block 8 rotates relative to the shaft 4 in direction R2, opposite to R1, the ring 55 is rotated in direction R2 via the cylinder block 8 until the stud comes into abutment in position 56B against the face 57B of the recess 57.

The embodiment shown in FIG. 11 in a configuration that is equivalent to that of FIG. 9 differs from the embodiment shown in FIG. 4 in that the following dispositions are taken:

the holes 62 are omitted;

the drain ducts 71 are replaced with other drain ducts 171 each of which opens out permanently in the cylindrical wall of a secondary piston 19, in the chamber 20 delimited by said secondary piston, and in the selector duct 22;

when an orifice 61 communicates with a duct 22, each secondary piston can take up two positions, one of which (not shown in FIG. 11) corresponds to the first configuration (already defined), in which the drive on the secondary piston 19 from the pressure of the fluid contained in ducts 58 and 22 is greater than that from the spring 24, the cylinder ducts 50 and 51 communicating with each other via the groove 84, and the drain duct 171 being closed off by the wall of the cylinder 17; the other position, shown in FIG. 11, corresponding to the second configuration (already defined, and shown in FIG. 9), in which the drive on the secondary piston 19 from the pressure of the fluid contained in ducts 58 and 22 is less than that from the spring 24, the groove 84 then being closed off by the wall of the cylinder 17, cylinder duct 51 being closed off by the secondary piston 19, and cylinder duct 50 communicating with chamber 20 and with ducts 22 and 58 via the drain duct 171.

In comparison with the preceding embodiments (FIGS. 1 to 6, FIGS. 7 to 9), it may be noted firstly that when the pressure in duct 58 is zero, and when the force of the spring 24 acts alone on the secondary piston 19, in the embodiments shown in FIGS. 1 to 9, the cylinder ducts 50 and 51 communicate with each other, whereas, in the embodiment shown in FIG. 11, cylinder duct 51 is closed off, cylinder duct 50 communicating with the tank 74 via the drain duct 171, the inverse operation being obtained when the drive from the pressure of the fluid contained in duct 58 is greater than the force of the spring 24. Appropriate choice of the embodiment thus makes it possible, in the rest position, i.e. in the absence of control, to choose either the maximum cubic capacity or the intermediate cubic capacity.

Incidentally, in the embodiment shown in FIG. 11, it will have been observed that, in the second configuration (shown in FIG. 11), by taking advantage of duct 58 being put into communication with the tank 74 while the force of the spring 24 is predominant, it is possible to put chamber 13 and cylinder duct 50 into communication with the tank 74 by means of the drain duct 171 putting ducts 58 and 59 into communication with duct 83 directly, thereby eliminating the various holes 62 and the duct 65 of the embodiments in FIGS. 1 to 9.

It should also be noted that a disposition including drain ducts that are analogous to duct 171 in FIG. 11 may be used both in the embodiments in which the secondary pistons 19 are provided with grooves 84 (FIGS. 7 to 9; FIG. 11), and also in the embodiments in which the secondary pistons 19 include connection ducts 70 (FIGS. 1 to 6).

The embodiment in FIGS. 12 and 13 is close to that in FIGS. 1 to 6, differing only in that the secondary cylinders are distributed over two groups of cylinders 17A, 17B, which in this case succeed each other angularly, a secondary cylinder 17A succeeding a secondary cylinder 17B, itself succeeding a secondary cylinder 17A, and so on. It should be understood that this particular disposition, in which there are the same number of secondary cylinders in each group, is not essential.

The secondary cylinders 17A, 17B correspond to first main pistons 12A, 12B which delimit chambers 13A, 13B, and the secondary cylinders receive secondary pistons 19A, 19B which are slidably mounted therein and which delimit respective chambers 20A, 20B therein. Chambers 20A, 20B communicate with the bore 21 via selector ducts 22A, 22B which are centered in distinct transverse planes P22A, P22B. Two separate ducts 58A, 58B that can contain fluids having different pressures are provided in the ring 55 and they open out in the cylindrical face 60 of said ring via orifices 61A, 61B that can communicate with respective ones of said selector ducts 22A, 22B. Each secondary piston 19A, 19B includes a drain duct 71A, 71B, analogous to ducts 71, and a connection duct 70A, 70B, analogous to ducts 70, and capable of putting into communication with each other the respective cylinder ducts 50A, 51A and 50B, 51B of the first cylinders 10A, 10B.

Each secondary piston 19A, 19B can take up two distinct configurations, depending on whether duct 58A, 58B contains unpressurized fluid or fluid under pressure, respectively. Through holes 62A, 62B permanently connect the faces of cylinders 17A, 17B to enclosure 63.

When an orifice 22 communicates with ducts 58A, 58B in the first configurations, shown in FIGS. 12 and 13, corresponding to the forces of the springs 24A, 24B being greater than the drive from the pressures of the fluids contained in ducts 58A, 58B, the secondary pistons 19A, 19B put the cylinder ducts 50A, 51A, and 50B, 51B into communication with each other and close off the through holes 62A, 62B, the walls of the cylinders 17A, 17B closing off the drain ducts 71A, 71B; whereas, in the second configurations (not shown), corresponding to the drive from the pressures of the fluids contained in ducts 58A, 58B being greater than the forces of the springs 24A, 24B, the walls of the secondary cylinders 17A, 17B close off connection ducts 70A, 70B, and the secondary pistons close off cylinder ducts 51A, 51B, and put drain ducts 71A, 71B into communication both with cylinder ducts 50A, 50B, and also with through holes 62A, 62B, respectively.

Operation of the above-described motors is described below.

It is assumed that the main pump 75 delivers a fluid under pressure via one of its main couplings, e.g. main coupling 75A, and that the two-position fluid distributor 79 is placed in its first position.

By way of example, the maximum delivery pressure of the main pump 75 may reach 400 bars, the control pressure of the fluid contained in duct 58, and delivered by pump 77, may lie in the range 20 bars to 30 bars, and it is limited by the rating of the discharge valve 78; and the retaining pressure prevailing in the enclosure 3, which pressure is limited by the retaining valve 85, is generally less than 10 bars.

With respect to the embodiment in FIGS. 1 to 6, the first configuration shown in FIGS. 1 to 3 is initially obtained. Each chamber 13, and each chamber 31 is periodically fed with fluid under pressure delivered by the main pump 75 via ducts 41, 43, and 46, the fluid then returning unpressurized to the main pump via ducts 47, 44, 42, each set of two cylinder ducts 50, 51 and of the connection duct 70 which interconnects them being equivalent to an uninterrupted single duct. The cubic capacity of the motor is equal to the sum of the cubic capacities corresponding to the displacements of the pistons 12 and 30 in the cylinders 10 and 27. Naturally, all of the rollers 14 and 32 are held against their respective cams under drive from the pressures of the fluids contained in chambers 13 and 31.

If the user then places the fluid distributor 79 in its second position, the second configuration shown in FIGS. 4 to 6 is obtained, the pressure of the control fluid delivered by the pump 77 into ducts 59 and 58 being sufficient to push back the various secondary pistons 19, merely by each selector duct 22 being put into communication with an orifice 61, which takes place only when the roller 14 of a piston 12 is approaching the crest 15 of the cam 15–16. In this configuration, firstly chamber 13 of the cylinder 10 containing said piston 12 is no longer fed with fluid under pressure as a result of cylinder duct 51 being closed off, secondly the fluid contained in chamber 13 can return to the tank 74 via ducts 50, 71, the hole 62, the enclosure 63, and duct 65, the cam 15–16 pushing the roller 14 and thus pushing the piston 12 back inside the cylinder 10, and thirdly, the pressure of the fluid contained in enclosure 3, which pressure is maintained by the retaining valve 85, has an effect on the faces of the pistons 12 provided with the rollers 14, thereby keeping said pistons 12 inside the cylinders 10 by separating the rollers slightly from the crests 15 of the cam 15–16. One after another, the first pistons 12 are retracted into their cylinders, and they remain retracted therein. The total cubic capacity of the motor is then equal only to the capacity which corresponds to the displacement of the pistons 30 in the second cylinders 27.

It should be observed that each first piston 12 was taken out of service automatically after it reached the crest 15 of the cam 15–16, and it remains out of contact with the cam, even though the motor continues to operate.

It is easy to understand that, starting from the second configuration, by putting the two-position fluid distributor 79 back into its first position, it is possible to put the various first pistons 12 back into service one after another. When such a piston, previously retracted inside its first cylinder 10, approaches the crest 15 of the cam corresponding to a secondary cylinder 17 whose selector duct 22 enters into communication with the orifice 61 and the duct 58 of the ring 55, once again, the secondary piston 19 puts the cylinder ducts 50, 51 into communication with the connection duct 70, thereby enabling chamber 13 to be fed with fluid that is then contained in duct 46, i.e. fluid that is under pressure. The first piston 12 is put back into service smoothly (i.e. without crashing) just when its roller 14 is placed facing a crest 15 of the cam, also automatically, the motor continuing to operate.

Naturally, the same operation as that described above is obtained with the embodiment shown in FIGS. 7 to 9.

The disposition shown in FIG. 10 enables each secondary piston 19 to be placed in either one of its two positions sufficiently in advance for the roller 14 of the corresponding first piston 12 to be taken out of contact, or else put back into contact with the cam 15–16 at the moment at which it is placed facing one of the crests 15 thereof. This disposition is automatically reversible by means of the stud which is automatically placed in abutment at 56A or 56B depending on the direction of rotation R1 or R2.

The advantage of the embodiment shown in FIG. 11 is described above: it lies in the fact that the holes 62 and the duct 65 are omitted, and it enables the intermediate cubic capacity of the motor to be obtained at rest, i.e. in the absence of control, instead of the maximum cubic capacity.

The embodiment shown in FIGS. 12 to 14 makes it possible for the user to choose to take out of service, one after another, all of the first pistons corresponding to secondary pistons 19A only, or the first pistons corresponding to secondary pistons 19B only, or all of the first pistons corresponding to secondary pistons 19A and 19B, or none of them, leaving them all in service. The choice of the total cubic capacity of the motor is thus increased. Furthermore, the solution is not limited to the design of two groups 19A and 19B of secondary pistons, but rather it is also physically applicable to designs providing more than two groups of secondary pistons.

The invention is not limited to the embodiments described, but rather it covers any variants which may be made to them without going beyond their ambit or their spirit.

In this way, although it is advantageous to use the space between two secondary cylinders 17 to place a cylinder 27 of the second group of cylinders, it is possible to implement the invention without said second cylinders 27 being provided, or, when they are provided, without them being placed in the spaces between two secondary cylinders 17.

In the same way, the control of the secondary pistons 19, which control is performed hydraulically in this example via the control pump 77, the two-position fluid distributor 79, and the ring 55, has electrical and/or electronic equivalents which may be used as part of the present invention.

We claim:

1. A hydraulic motor having radial pistons and a device for selecting its active cubic capacity, the motor comprising:

a cam having a plurality of undulations, each undulation comprising a crest placed between two troughs;

a cylinder block mounted to rotate about an axis of rotation relative to the cam;

a plurality of cylinders provided in the cylinder block, and disposed radially relative to said axis of rotation;

a plurality of pistons slidably mounted inside the cylinders, each piston delimiting a fluid working chamber inside the cylinder in which it is mounted, and being urged against said cam under drive from the pressure of a fluid under pressure contained in said working chamber;

a main inlet fluid enclosure for the fluid under pressure and a main outlet fluid enclosure;

an internal fluid distributor co-operating with the cylinder block, while the cylinder block rotates relative to the cam, to put each working chamber into communication alternately with the main inlet enclosure and with the main outlet enclosure;

a plurality of individual feed selectors disposed in the cylinder block, each individual selector being associated with a cylinder belonging to a specific group of said cylinders, and being interposed between the working chamber delimited inside said cylinder and the internal fluid distributor; and means for returning the pistons slidably mounted in the cylinders of said specific group of cylinders towards the configuration in which the pistons are retracted inside their respective cylinders;

the motor being organized in such manner that firstly each individual feed selector can be placed in two specific configurations, said feed selector being coupled to a return member for returning said feed selector to one of said specific configurations, and to a control member for putting said feed selector in place in the other of said two specific configurations, said control member being connected to a control device, and having the opposite effect to that of the return member; secondly, when said individual feed selector is in said one specific configuration, the working chamber delimited inside the cylinder associated with the individual selector can, while the cylinder block is rotating relative to the cam, be put into communication alternately with the main inlet enclosure and with the main outlet enclosure via the internal fluid distributor; and thirdly, when said individual feed selector is in the other of said two specific configurations, said working chamber is isolated at least from the main inlet enclosure;

wherein the control member coupled to each of said individual feed selectors can work only in a range of positions of the cylinder associated with said individual feed selector which corresponds to the axis of said cylinder being in alignment with the crest of one of said undulations of the cam, and to positions that are angularly adjacent to the position in which said alignment is obtained.

2. A hydraulic motor according to claim 1, wherein each control member includes an individual feed link for feeding control energy, the control device for controlling the various control members is coupled to a casing partly formed by the cam and includes at least one control link that can be selectively put into communication with a control energy source, and, while the cylinder block is being rotated relative to the cam, said feed links of the various control members are individually put into communication with the control link of the control device.

3. A hydraulic motor according to claim 2, wherein said control device is mounted to pivot relative to said cam about said axis of rotation, so as to be subjected to an angular offset of determined value between two positions that the control device can take up, one of which positions corresponds to said cylinder block being rotated relative to the cam in a first rotation direction, the other position corresponding to said cylinder block being rotated relative to the cam in a second rotation direction opposite to the first direction.

4. A hydraulic motor according to claim 1, wherein each individual feed selector includes a drain duct which, when the individual feed selector is in the other of said specific configurations, connects said working chamber to an unpressurized enclosure.

5. A hydraulic motor according to claim 1, including two groups of cylinders whose axes are contained in distinct planes that are mutually parallel, and that are perpendicular to the axis of rotation, the cylinders of a first group of said two groups constituting said specific group of cylinders, the individual feed selectors associated with the cylinders of said first group of cylinders being disposed radially, each selector lying substantially in the radial plane containing the axis of the associated cylinder, and also being disposed between the radial planes containing the axes of two successive cylinders of a second group of said two groups.

6. A hydraulic motor according to claim 2, wherein the control member of each individual feed selector comprises a fluid actuator including a driving chamber and a feed channel constituting said individual feed link which, while the cylinder block is rotating relative to the cam, can communicate with a control channel constituting said control link, said control channel being itself selectively linked to a control fluid source via a control fluid distributor.

7. A hydraulic motor according to claim 1, wherein the return member coupled to each individual feed selector comprises a spring.

8. A hydraulic motor according to claim 1, including a casing which delimits a sealed enclosure containing said cylinder block and is in communication with a source of fluid under pressure, and said means for returning the pistons towards the configuration, in which the pistons are retracted inside the cylinders, are constituted by said enclosure and by the fluid under pressure contained in said enclosure.

9. A hydraulic motor according to claim 1, wherein each individual feed selector comprises a moving member which is mounted to slide relative to the cylinder block parallel to a slide axis, which is constrained to rotate with the cylinder block about said slide axis, and which is provided with a through hole which, when the individual feed selector is in said one specific configuration, can put the associated cylinder into communication with the internal fluid distributor.

* * * * *